US008060003B2

(12) United States Patent
Yoshizawa

(10) Patent No.: US 8,060,003 B2
(45) Date of Patent: Nov. 15, 2011

(54) IMAGE FORMING APPARATUS WHEREIN A SETTING UNIT SETS AN INTERVAL OF IMAGE FORMATION ACCORDING TO A SIZE OF A RECORDING MEDIUM

(75) Inventor: Ryuichi Yoshizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 697 days.

(21) Appl. No.: 11/873,301

(22) Filed: Oct. 16, 2007

(65) Prior Publication Data

US 2008/0095549 A1 Apr. 24, 2008

(30) Foreign Application Priority Data

Oct. 20, 2006 (JP) ..... 2006-286471

(51) Int. Cl.
*G03G 15/00* (2006.01)

(52) U.S. Cl. ..... 399/396; 399/308; 399/302; 399/388; 399/389; 399/66

(58) Field of Classification Search ..... 399/66, 399/396, 388, 389, 308, 302
See application file for complete search history.

(56) References Cited

U.S. PATENT DOCUMENTS

| | | | | |
|---|---|---|---|---|
| 5,862,430 | A * | 1/1999 | Mitekura et al. | 399/13 |
| 6,801,728 | B2 * | 10/2004 | Taguchi et al. | 399/66 |
| 6,839,526 | B2 * | 1/2005 | Shibata | 399/82 |
| 7,072,608 | B2 | 7/2006 | Takada | |
| 7,113,715 | B2 * | 9/2006 | Yang et al. | 399/66 |
| 2004/0126128 | A1 * | 7/2004 | Shibata | 399/82 |

FOREIGN PATENT DOCUMENTS

| | | | |
|---|---|---|---|
| CN | 1470950 | A | 1/2004 |
| JP | 09-146319 | A | 6/1997 |
| JP | 2000-007170 | A | 1/2000 |
| JP | 2000-272781 | A | 10/2000 |

* cited by examiner

*Primary Examiner* — Matthew G Marini

(74) *Attorney, Agent, or Firm* — Canon USA Inc. IP Division

(57) ABSTRACT

An image forming apparatus includes a paper cassette feeding a recording material, an image forming unit forming an image on a photosensitive member, a primary transfer roller transferring the image onto an intermediate transfer belt, a secondary transfer roller transferring the image onto the recording material, and a sensor detecting the size of the recording material. The timing of starting feeding the recording material is later than the timing of starting forming the image. When image formation on the recording material is started, until the sensor detects the size of the recording material, a plurality of images are formed on the intermediate transfer belt at a first interval according to a predetermined recording material size, and after the sensor detects the size of the recording material, a plurality of images are formed on the intermediate transfer belt at a second interval according to the detected recording material size.

16 Claims, 10 Drawing Sheets

IMAGE FORMING APPARATUS WHEREIN A SETTING UNIT SETS AN INTERVAL OF IMAGE FORMATION ACCORDING TO A SIZE OF A RECORDING MEDIUM

BACKGROUND OF THE INVENTION

1. Field of the Invention

The present invention relates to an electrophotographic or electrostatic image forming apparatus such as a copying machine or printer.

2. Description of the Related Art

FIG. 1 illustrates an example structure of a color laser printer as an image forming apparatus. As shown in FIG. 1, the color laser printer forms electrostatic latent images on photosensitive members in image forming units with light emitted based on image signals transmitted from a controller (not shown). The electrostatic latent images formed on the photosensitive members are developed. The visible images are transferred in a superposed manner onto an intermediate transfer member so as to form a color visible image. This color visible image is transferred onto a recording material 2 and is then fixed.

The image forming units are aligned and develop four colors (yellow (Y), magenta (M), cyan (C), and black (K)). Each image forming unit has a photosensitive member (5Y, 5M, 5C, or 5K). Each image forming unit has a charger (7Y, 7M, 7C, or 7K) serving as a primary charging unit, and a developer (8Y, 8M, 8C, or 8K). The color laser printer further includes toner cartridges (11Y, 11M, 11C, and 11K) for supplying toners, an intermediate transfer member 12, a paper feeding unit 1, primary transfer units (29Y, 29M, 29C, and 29K), a secondary transfer unit 9, and a fixing unit 13.

The photosensitive members (5Y, 5M, 5C, and 5K), the chargers (7Y, 7M, 7C, and 7K) serving as primary charging units, and the developing units (8Y, 8M, 8C, and 8K) are integrated in process cartridges (22Y, 22M, 22C, and 22K) that are detachable from the image forming apparatus main body.

The photosensitive drums (also referred to as photosensitive members) 5Y, 5M, 5C, and 5K each include an aluminum cylinder and an organic photoconductive layer applied to the periphery of the cylinder. The driving force of a driving motor (not shown) is transmitted to the photosensitive drums 5Y, 5M, 5C, and 5K to rotate them. The driving motor rotates the photosensitive drums 5Y, 5M, 5C, and 5K counterclockwise in the figure in accordance with image forming operation. The photosensitive drums 5Y, 5M, 5C, and 5K are irradiated with light emitted from scanner units 10Y, 10M, 10C, and 10K. The surfaces of the photosensitive drums 5Y, 5M, 5C, and 5K are selectively irradiated with light in accordance with image signals so that electrostatic latent images are formed.

The four chargers 7Y, 7M, 7C, and 7K serving as primary charging units charge the yellow (Y), magenta (M), cyan (C), and black (K) photosensitive members. Each charger includes a charging roller (also referred to as charging sleeve) 7YS, 7MS, 7CS, or 7KS.

The four developers 8Y, 8M, 8C, and 8K, which serve as developing units, perform development of yellow (Y), magenta (M), cyan (C), and black (K) to make the electrostatic latent images visible. Each developer includes a developing roller (also referred to as developing sleeve) 8YS, 8MS, 8CS, or 8KS. Each developer is detachable. The intermediate transfer member 12 is in contact with the photosensitive drums 5Y, 5M, 5C, and 5K. The intermediate transfer member 12 rotates clockwise in the figure during the image formation. A drive roller 18 drives the intermediate transfer member 12. The visible images on the rotating photosensitive drums 5Y, 5M, 5C, and 5K are transferred to the intermediate transfer member 12. A transfer roller (29Y, 29M, 29C, 29K) is a member to transfer the visible image from the photosensitive drums to the intermediate transfer member 12. Each of the transfer rollers (29Y, 29M, 29C, 29K) is positioned at the position facing each of plural drums (5Y, 5M, 5C, and 5K).

During the image formation, a below-described transfer roller 9*a* comes into contact with the intermediate transfer member 12, the recording material 2 being nipped and conveyed. The color visible image formed on the intermediate transfer member 12 by the image forming units is transferred onto the recording material 2. While the color visible image is transferred onto the recording material 2, the transfer roller 9*a* is in contact with the intermediate transfer member 12. At the end of the printing process, the transfer roller 9*a* moves to a position 9*b*.

While conveying the recording material 2, the fixing unit 13 fixes the color visible image transferred on the recording material 2. The fixing unit 13 includes a fixing roller 14 that heats the recording material 2, and a pressing roller 15 that presses the recording material 2 against the fixing roller 14. The fixing roller 14 and pressing roller 15 are hollow and house heaters 16 and 17, respectively. The recording material 2 holding the color visible image is conveyed by the fixing roller 14 and pressing roller 15, and heated and pressed so that the toner is fixed on the surface. After the visible image is fixed, the image forming operation is ended by ejecting the recording material 2 onto a paper ejecting section.

The color laser printer detects the conveying position and monitors the conveying state with sensors 23, 24, 25, 26, and 19, a pre-fixing sensor 27, a fixing/ejecting sensor 20, and an ejecting sensor 28 in a recording material conveying path. The sensors 23 and 25 detect a recording material supplied from a lower cassette 1B. The sensors 24 and 26 detect a recording material supplied from an upper cassette 1A.

A cleaner 21 serving as a cleaning unit 21 removes toners remaining on the intermediate transfer member 12. After the color visible image formed on the intermediate transfer member 12 is transferred onto the recording material 2, the cleaner 21 removes toners remaining on the intermediate transfer member 12 and stores the toners in a cleaner container.

A color misregistration sensor 6 detects the color misregistration of the image formed on the intermediate transfer member 12. A density sensor 4 detects the density of the image. Based on the detection results of these sensors, the color misregistration and density are corrected.

FIG. 2 is a block diagram illustrating a system configuration of the image forming apparatus. A controller 201 is capable of two-way communication with a host computer 200 and an engine control unit 202 (arrows 222 and 220 in FIG. 2). The engine control unit 202 includes a CPU 211 in communication with an image processing GA 212, image control unit 213, fixing control unit 214, sheet conveying unit 215 and driving control unit 216. The CPU and image processing GA are further in interfaced with video interface unit 210 which is interfaced to the controller 201 via lines 220 and 221.

The controller 201 receives image information and printing conditions from the host computer 200. The controller 201 transmits a print reservation command to the engine control unit 202 to make a reservation for a printing operation based on the received printing conditions and printing information (paper feeding unit, recording material size, printing mode, and so forth) of each recording material. The controller 201 analyzes the received image information and converts the image information into bitmap data (printing data). At the end of the analysis of the image information, the controller part 201 transmits a print start command for instructing to start the printing operation and printing data to the engine control unit 202.

Receiving the print start command, the engine control unit 202 outputs a /TOP signal (arrow 221 in FIG. 2) and starts the paper feeding operation. The /TOP signal serves as the reference timing of outputting of an image signal to the first image forming unit. After temporarily stopping the fed recording material at the registration roller 3 (see FIG. 1), the engine control unit 202 refeeds the recording material from the position of the registration roller 3 when the toner image formed on the intermediate transfer member reaches the secondary transfer position.

This /TOP signal instructs to write an image on the photosensitive drum in the image forming unit. The engine control unit 202 outputs this /TOP signal, and a latent image is formed on the photosensitive drum.

In the above-described image forming apparatus, the distance (A in FIG. 1) from the image formation starting position (developing position) of the first (yellow) image forming unit to the secondary transfer position can be larger than the distance (B) from the paper feeding position to the secondary transfer position.

In this case, the number of images formed per unit time (hereinafter referred to as throughput) can be increased by forming a plurality of pages of images on the intermediate transfer member when a recording material is fed or when the recording material is refed from the registration roller 3. Therefore, control has been performed so that images are formed on the intermediate transfer member before a recording material is fed or refed.

The first image forming unit refers to the yellow image forming unit. The image formation starting position refers to the position where the development is started on the photosensitive drum. In FIG. 1, the image formation starting position corresponds to the position where a toner image is developed on the yellow photosensitive drum.

FIG. 3 is a timing chart in the case where a plurality of pages of images are formed on the intermediate transfer member to increase throughput. Throughput means the number of images formed per unit time.

Receiving a print start command from the controller 201, the engine control unit 202 performs a preparation operation for printing. After completion of the preparation operation, the engine control unit 202 outputs a /TOP signal for the first recording material and outputs /TOP signals for the subsequent recording materials so that the time interval between successive /TOP signals (311, 321, and 331) for the recording materials has a desired value. A predetermined time after outputting the /TOP signal for each recording material, the engine control unit 202 starts the paper feeding operation (312, 322, and 332). Based on the time points (313, 323, and 333) when the supplied recording materials reach the registration roller 3, the engine control unit 202 conveys the leading edge of each recording material to a desired position and temporarily stops the conveyance of the recording materials (314, 324, and 334). In addition, time points (316, 326, 336) are the timing when an end of the recording material passes sensor 19. In synchronization with the conveyance of the toner images formed on the intermediate transfer member, the engine control unit 202 resumes the conveyance of the recording materials (315, 325, and 335) and transfers the toner images onto the recording materials. When the refeeding of the first sheet is started, the image formation for the third sheet is started.

In order to perform the above-described operation, it is necessary to form images on the intermediate transfer member so that there is a suitable distance (spacing) between the images to be transferred onto successive sheets of recording material. During feeding of a series of sheets to the secondary transfer unit there must be some gap between the trailing edge of one sheet and the leading edge of the next sheet. However, the minimum interval between sheets arriving at the secondary transfer unit is mainly determined by the sheet size in the direction in which the sheets are conveyed. Therefore, the engine control unit 202 needs to know the size of recording material in advance.

In the case where the size of recording material is not known in advance, the size of the first fed recording material is detected with a sensor in the recording material conveying path. After the size of the first recording material is detected, paper feeding operations are performed at an interval based on the detected size of recording material. This is disclosed in Japanese Patent Laid-Open No. 2000-272781.

FIG. 4 is a timing chart showing the operation in the case where the distance (A in FIG. 1) from the image formation starting position in the first image forming unit to the secondary transfer position is larger than the distance (B in FIG. 1) from the paper feeding position to the secondary transfer position, and the size of recording material is initially unknown (undetermined).

The engine control unit 202 outputs the /TOP signal of the first sheet (411) and image formation for the first sheet is commenced at that time. The engine control unit 202 also starts a paper feeding operation (412) for the first sheet a predetermined time after outputting the /TOP signal for that sheet. Based on the time point (413) when the supplied recording material reaches the registration roller 3, the engine control unit 202 conveys the leading edge of the first sheet of recording material to a desired position and temporarily stops the conveyance of the recording material (414). After that, in synchronization with the conveyance of the toner image formed on the intermediate transfer member, the conveyance of the first sheet of recording material is resumed (415) so that the toner image is transferred onto the first sheet of recording material. At this time, the engine control unit 202 carries out a size detection operation to detect the length in the conveying direction of the first recording material (hereinafter also referred to as actual length of recording material) based on the time from when the leading edge of the first recording material reaches the registration sensor 19 to when the trailing edge of the recording material leaves the registration sensor 19. Thus, completion (416) of the size detection operation does not occur until the trailing edge of the first sheet has reached the registration sensor 19.

When the trailing edge of the first sheet of recording material leaves the registration sensor 19, the engine control unit 202 starts the printing operation of the second sheet and outputs the /TOP signal of the second sheet (421). The engine control unit 202 outputs the /TOP signals of the second and subsequent sheets at an interval according to the detected length of recording material so that an optimum throughput can be achieved. Reference numeral 422 denotes the start of feeding of the second recording material. Reference numeral 423 denotes the time point when the second recording material reaches the registration roller. Reference numerals 424 and 425 denote the timing of driving the registration roller for the second recording material. Reference numeral 431 denotes the /TOP signal of the third recording material. Reference numeral 432 denotes the start of feeding of the third recording material. Reference numeral 433 denotes the time point when the third recording material reaches the registration roller. Reference numerals 434 and 435 denote the timing of driving the registration roller for the third recording material.

However, because in this case the size of recording material is initially unknown, the engine control unit 202 has to delay the output of the /TOP signal of the second sheet until the detection of the sheet size is completed based on the first sheet (i.e., until the first sheet leaves the sensor 19). Therefore, compared to the case where the size of recording material is known in advance, the printing interval between the first and second sheet is larger. This degrades throughput and therefore performance of the image forming apparatus.

The larger the distance from the image formation starting position of the first image forming unit on the intermediate transfer member to the secondary transfer position, the larger the degradation in performance.

SUMMARY OF THE INVENTION

The present invention is directed to performing image forming operation so that the degradation in performance is minimized even if the size of recording material is unknown.

In an image forming apparatus in which the distance from the image formation starting position of the image forming unit to the secondary transfer position is larger than the distance from the paper feeding position to the secondary transfer position, the present invention can prevent degradation in performance even if the size of recording material is unknown.

In an aspect of the present invention, an image forming apparatus includes a paper feeding unit configured to feed a recording material, an image forming unit configured to form an image on an image bearing member, a primary transfer unit configured to transfer the image formed on the image bearing member onto an intermediate transfer member, a secondary transfer unit configured to transfer the image transferred onto the intermediate transfer member onto the recording material fed from the paper feeding unit, a size detecting unit configured to detect the size of the recording material, and a setting unit configured to set the interval of image formation. The timing of starting feeding the recording material from the paper feeding unit is earlier than the timing of starting forming the image with the image forming unit. The setting unit sets the interval of image formation so that when image formation on the recording material is started, until the size detecting unit detects the size of the recording material, a plurality of images are formed on the intermediate transfer member at a first interval according to a predetermined recording material size, and after the size detecting unit detects the size of the recording material, a plurality of images are formed on the intermediate transfer member at a second interval according to the detected recording material size.

In another aspect of the present invention, an image forming apparatus includes a paper feeding unit configured to feed a recording material, an image forming unit configured to form an image on an image bearing member, a primary transfer unit configured to transfer the image formed on the image bearing member onto an intermediate transfer member, a secondary transfer unit configured to transfer the image transferred onto the intermediate transfer member onto the recording material fed from the paper feeding unit, a size detecting unit configured to detect the size of the recording material, a setting unit configured to set the interval of image formation, and a specifying unit configured to specify a recording material size. The timing of starting feeding the recording material from the paper feeding unit is earlier than the timing of starting forming the image with the image forming unit. The setting unit sets the interval of image formation so that when image formation on the recording material is started, a plurality of images are formed on the intermediate transfer member at a first interval according to the recording material size specified by the specifying unit, and after the size detecting unit detects the size of the recording material, a plurality of images are formed on the intermediate transfer member at a second interval according to the detected recording material size.

Further features of the present invention will become apparent from the following description of exemplary embodiments with reference to the attached drawings.

DESCRIPTION OF THE EMBODIMENTS

Various embodiments, features and aspects of the present invention will now herein be described with reference to the drawings.

First Exemplary Embodiment

Figure 1:
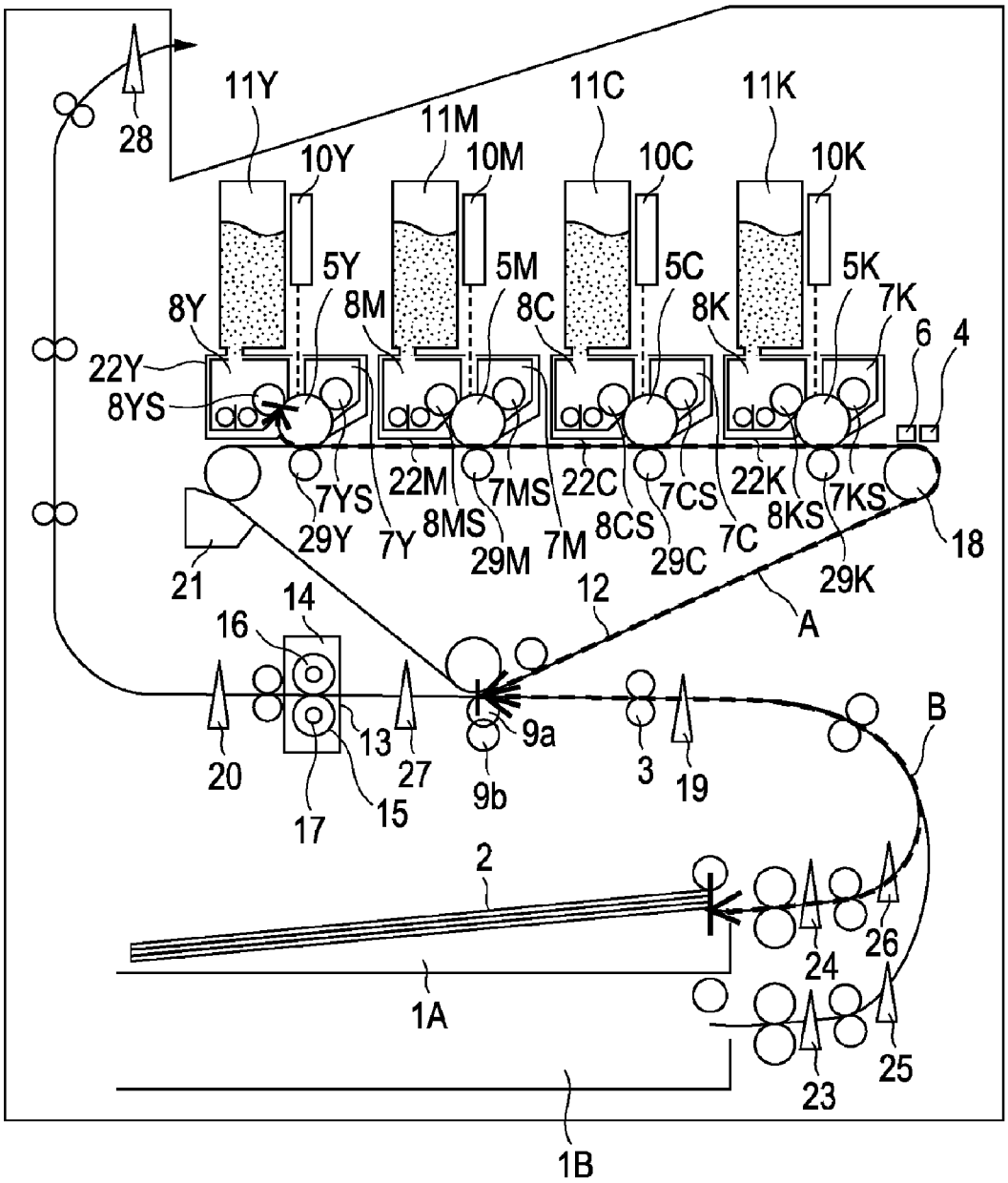
FIG. 1 illustrates an overall example structure of a color laser printer as an example of an image forming apparatus to which the present invention is applicable.

Since the structure and operation of a color laser printer as an image forming apparatus are similar to those of FIG. 1, the detailed description will be omitted. It will be assumed in the present embodiment that the distance from the image formation starting position of the first image forming unit to the secondary transfer position is larger than the distance from the paper feeding position to the secondary transfer position. Here will be described how to perform the image forming operation without degrading performance in this case even if the size of recording material (hereinafter referred to as "sheet") is unknown.

Figure 2:
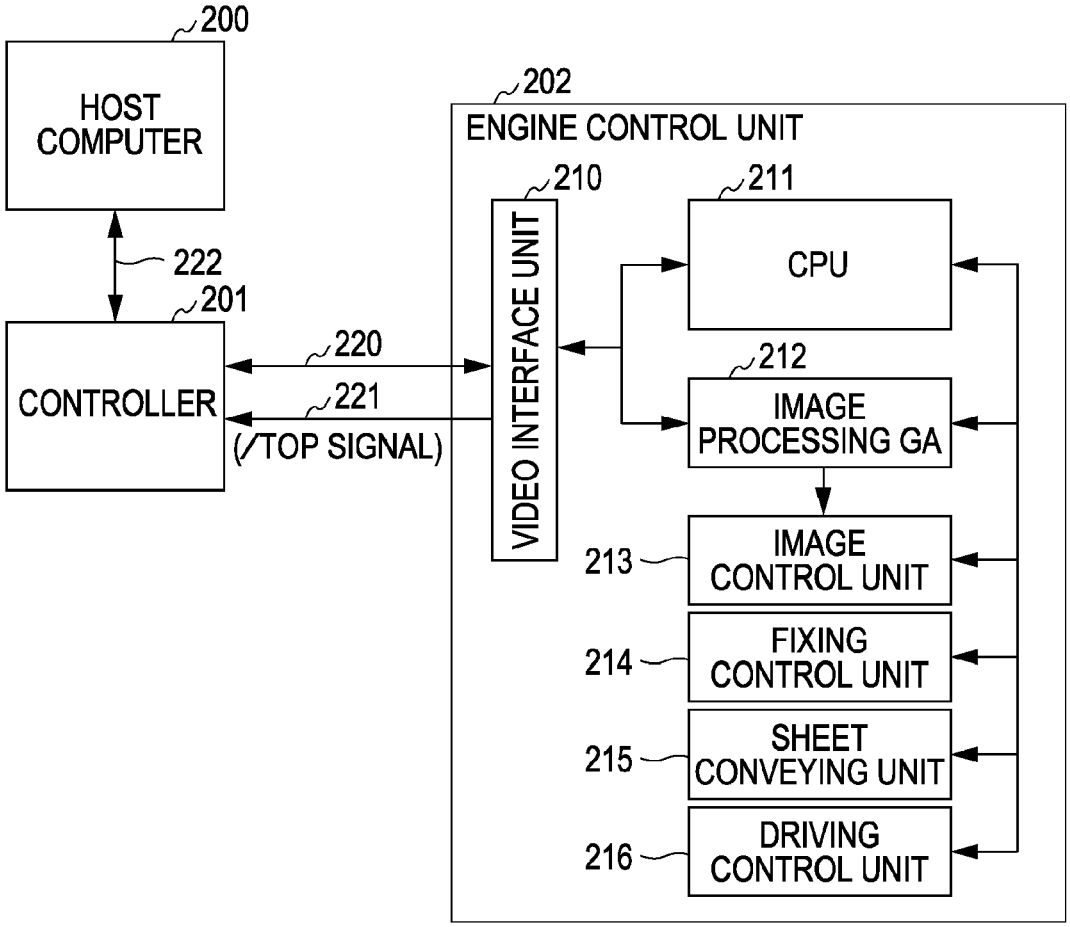
FIG. 2 is a block diagram of parts of the color laser printer of FIG. 1.
Figure 3:
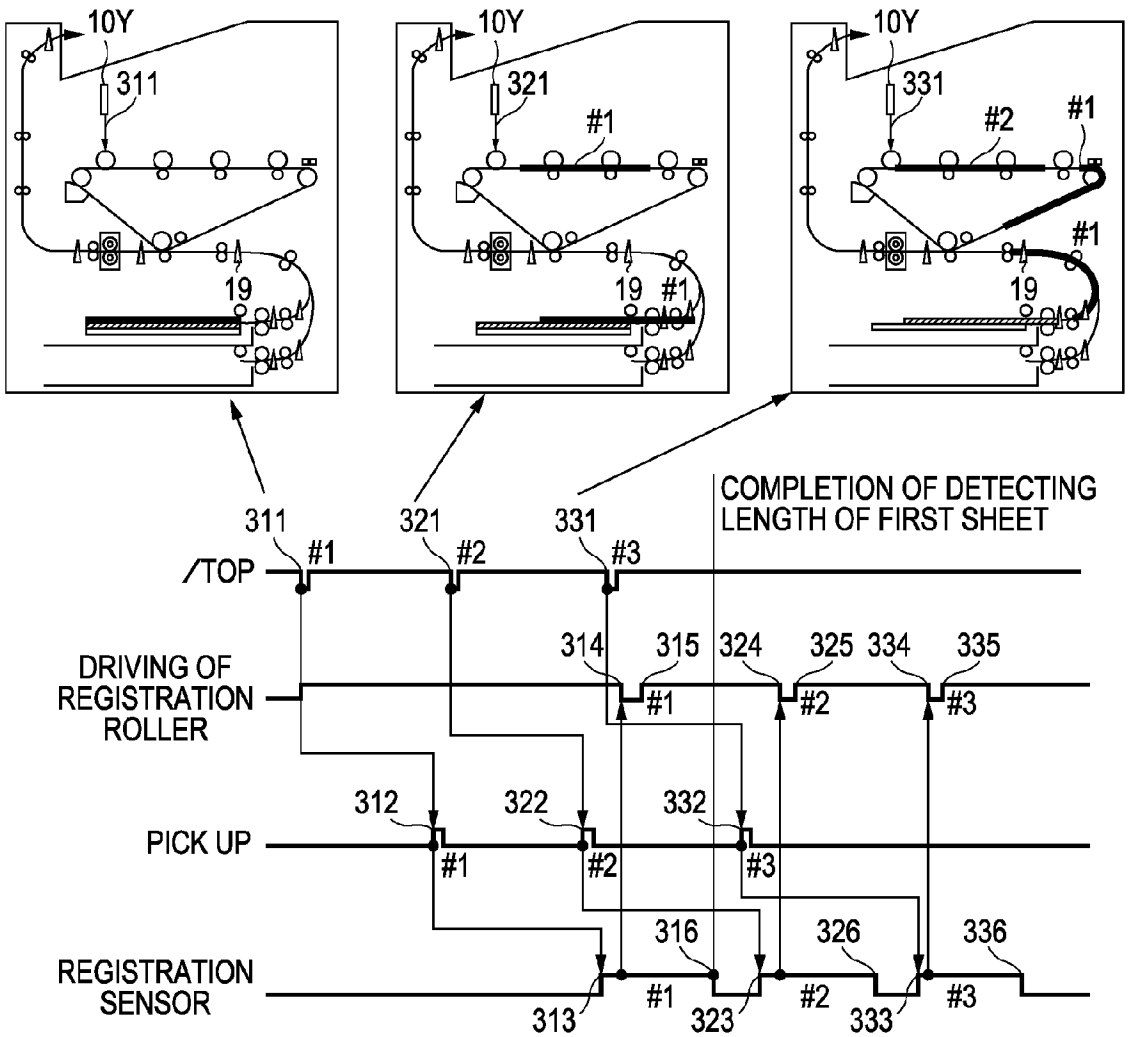
FIG. 3 PRIOR ART
FIG. 3 is a timing chart for use in explaining a conventional method of improving throughput in the FIG. 1 printer.

Since the system configuration of the image forming apparatus is the same as that of FIG. 2, the detailed description will be omitted. The first image forming unit refers to the yellow image forming unit. The image formation starting position refers to the position where the development is started on the photosensitive drum. In this embodiment, until the engine control unit 202 detects the length of recording material, the engine control unit 202 outputs /TOP signals at such an interval that printing can be performed on the maximum size sheets that can be set in the paper feeding unit. After detecting the length of sheet, the engine control unit 202 outputs /TOP signals at an interval according to the detected length of sheet so that an optimum throughput can be achieved.

Here will be described an example case where the maximum size sheets that can be set in the paper feeding unit are legal size (sheet size in the conveying direction: 355.6 mm), and sheets actually set in the paper feeding unit are letter size (sheet size in the conveying direction: 279.4 mm).

Figure 5:
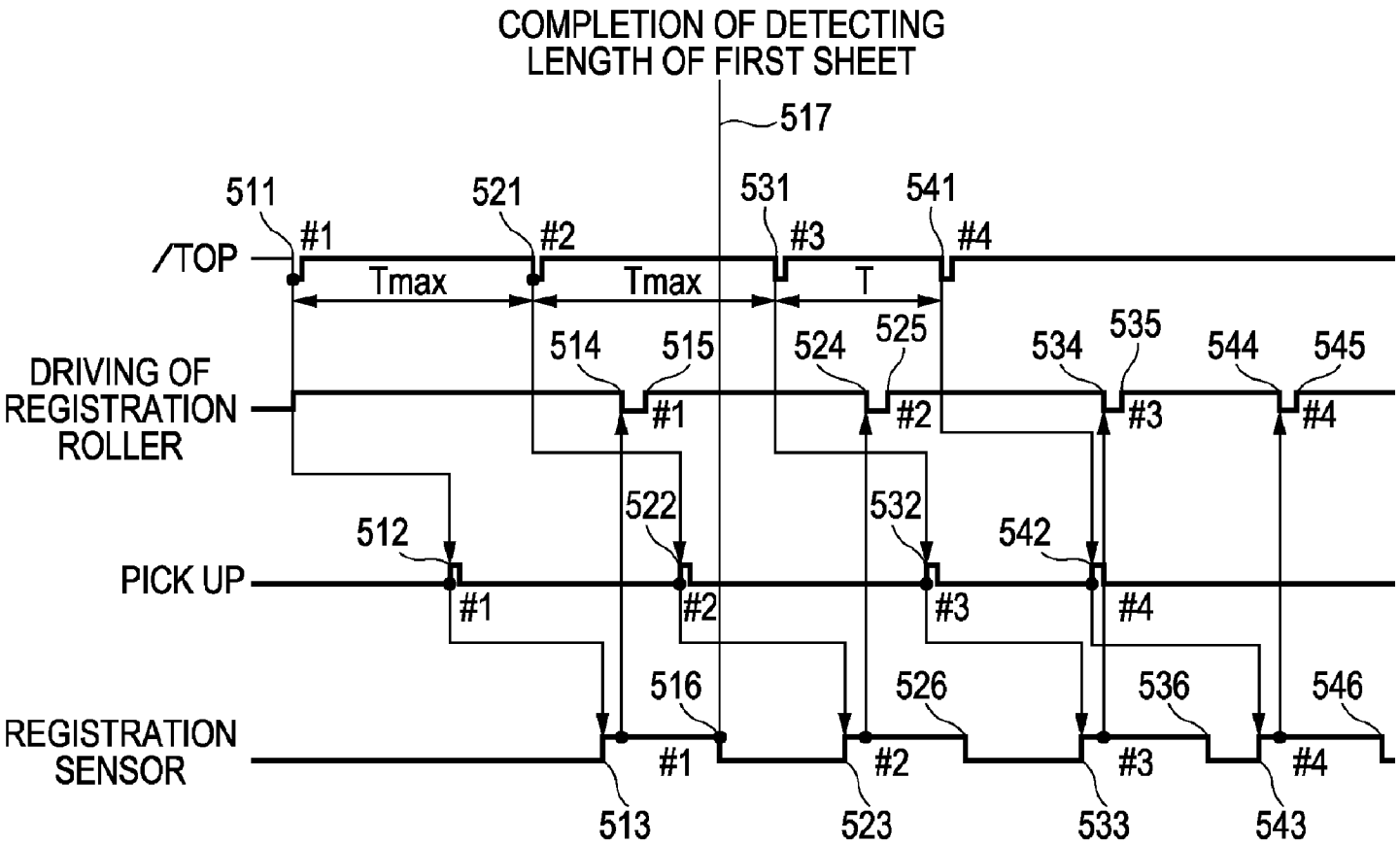
FIG. 5 is a timing chart illustrating the printing operation in a first embodiment.

FIG. 5 is a timing chart of the printing operation utilized in the first embodiment. Since the sheet size is unknown (undetermined), the engine control unit 202 outputs the /TOP signal of the first sheet and then outputs /TOP signals (511, 521, 531) for the subsequent sheets based on the premise that the sheets are legal size. The time interval between the /TOP signals is Tmax based on the maximum size (legal size). That is to say, Tmax=(legal size)+margin. The margin is a value that is appropriately set in accordance with the paper feeding interval.

A predetermined time after outputting the /TOP signal of the first sheet, the engine control unit 202 starts the paper feeding operation (512) for the first sheet. Based on the time point (513) when the supplied first sheet reaches the registration roller 3, the engine control unit 202 conveys the leading edge of the first sheet to a desired position and temporarily stops the conveyance of the sheet (514). In synchronization with the toner image for the first sheet formed on the intermediate transfer member, the engine control unit 202 resumes the conveyance of the sheet (515) and transfers the toner image onto the sheet. At this time, the engine control unit 202 measures the time from when the leading edge of the first sheet reaches the sensor 19 (513) to when the trailing edge of the sheet leaves the sensor 19 (516), and based on the result, calculates the actual size of the first sheet, the size detection operation being completed at time 517.

In the present example, a /TOP signal for the second sheet is output (521) before the detection of the length of the first sheet is completed. The engine control unit 202 uses Tmax as the interval between the /TOP signals for the first and second sheets. This operation is based on the premise that the maximum size (legal size) sheets are set in the paper feeding unit. The interval Tmax has a predetermined value and is set independently of the size detection operation. The size detection operation in this example is completed before the /TOP signal for the third sheet is output but, in this embodiment, the interval Tmax is used once again as the interval between the /TOP signals for the second and third sheets. In this embodiment the engine control unit switches to using an interval T based on the detected length of sheet (sheet size) starting with the interval between the /TOP signals (541) for the third and fourth sheets.

In the case of FIG. 5 of this embodiment, since the detection of the length of the first sheet is completed after the /TOP signal of the second sheet, the outputting interval Tmax between the /TOP signals of the second and third sheets is determined based on the legal size. After the /TOP signal of the third sheet is output, since the detection of the length of the first sheet is already completed (517), the outputting interval T between the /TOP signals of the third and subsequent sheets is set based on the detected length of the sheet (letter size). Reference numeral 522 denotes the start of feeding of the second recording material. Reference numeral 523 denotes the time point when the second recording material reaches the registration roller. Reference numeral 526 denotes the time point when the end of the second recording material passes the sensor 19. Reference numerals 524 and 525 denote the timing of driving the registration roller for the second recording material. Reference numeral 532 denotes the start of feeding of the third recording material. Reference numeral 533 denotes the time point when the third recording material reaches the registration roller. Reference numeral 536 denotes the time point when the end of the third recording material passes the sensor 19. Reference numerals 534 and 535 denote the timing of driving the registration roller for the third recording material.

Figure 6:
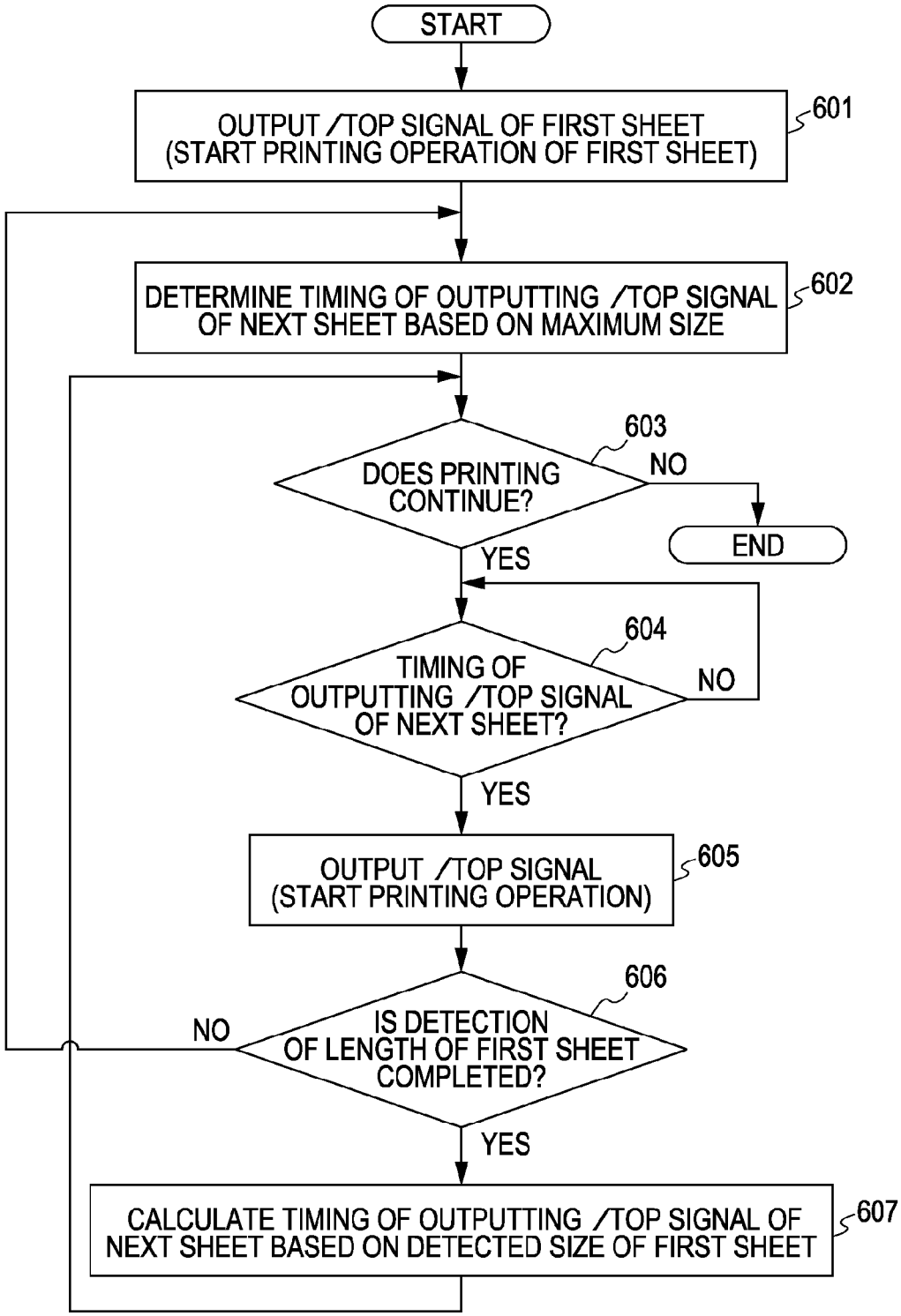
FIG. 6 is a flowchart illustrating the printing operation in the first embodiment.

FIG. 6 is a flowchart illustrating the operational timing in this embodiment. The engine control unit 202 outputs the /TOP signal of the first sheet and sets the timing of outputting the /TOP signal of the second sheet based on the maximum size (legal size) (601 and 602). Next, it is determined whether printing continues (603). If not, the process ends. If printing continues, the process proceeds to 604.

At the timing of outputting the /TOP signal of the second sheet, the engine control unit 202 outputs the /TOP signal of the second sheet (604 and 605). After outputting the /TOP signal of the second sheet, the engine control unit 202 checks if the detection of the length of the first sheet is completed (606).

If the detection of the length of the first sheet is completed, the timing of outputting the /TOP signal of the next sheet is set based on the detected length of sheet (letter size) (607). If the detection of the length of the first sheet is not completed, as with the second sheet, the timing of outputting the /TOP signal of the third sheet is set based on the maximum size (legal size).

Hereafter, the timing of outputting the /TOP signal of the next sheet is determined depending on whether or not the detection of the length of the first sheet is completed.

As described above, until the engine control unit 202 detects the length of sheet, the engine control unit 202 outputs /TOP signals at such an interval that printing can be performed on the maximum size (legal size in this embodiment) sheets that can be set in the paper feeding unit.

That is to say, since /TOP signals are output based on the maximum size before the detection of the length of sheet is completed, the interval between the first and second sheets is smaller compared to the conventional method in which /TOP signals are output after the detection of the length of sheet is completed.

Figure 4:
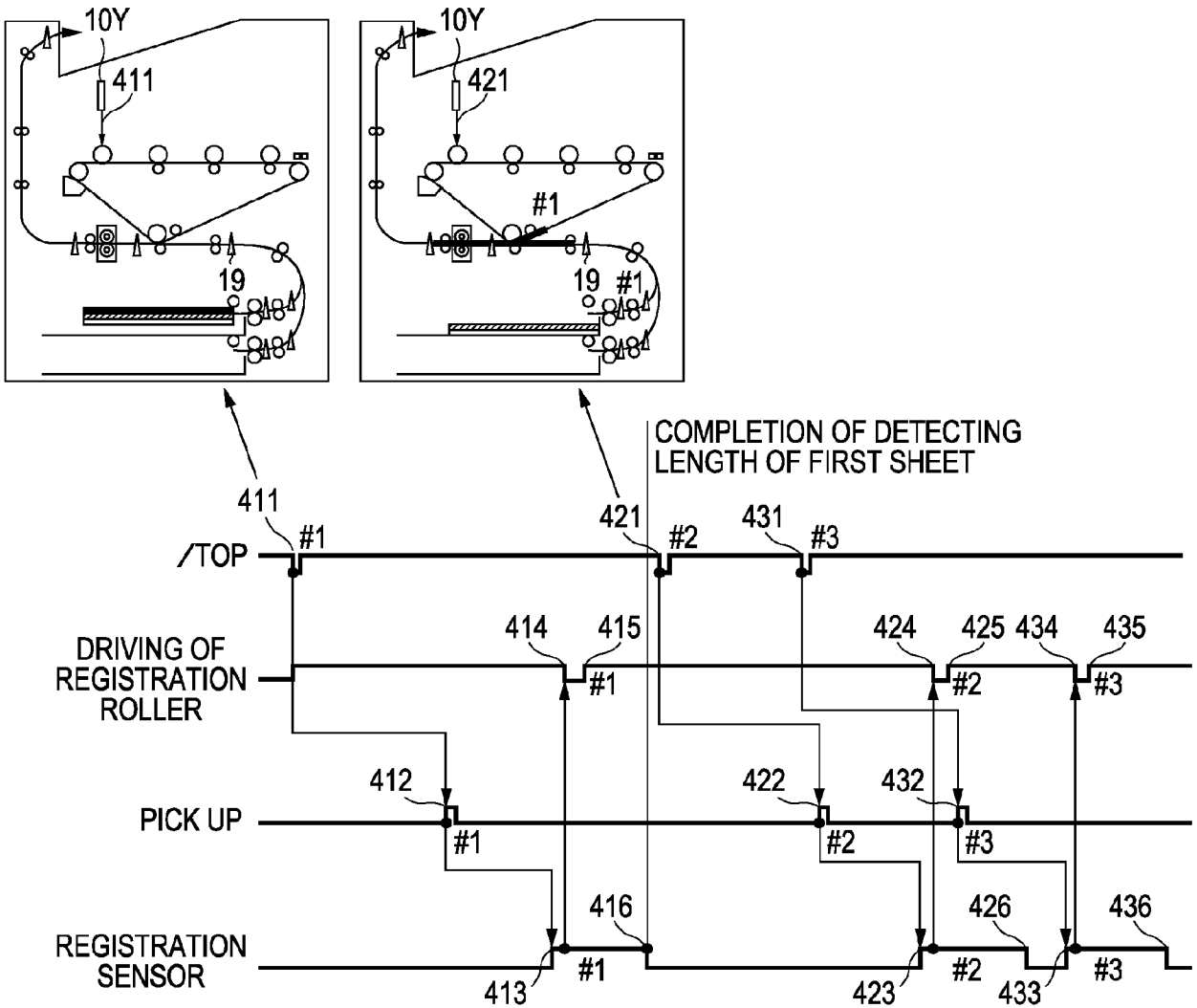
FIG. 4 is a timing chart for use in explaining the printing operation in the FIG. 1 printer in the case where the sheet size is unknown.

In the conventional method, after the image of the first sheet is formed on the intermediate transfer member until the detection of the length of the first sheet is completed, image formation of the second sheet is not performed. In contrast, in the method of this embodiment, the image of the second sheet can be formed without waiting for the completion of detecting the length of the first sheet. The interval between /TOP signals #1 and #2 in FIG. 5 of this embodiment is smaller than the interval between /TOP signals #1 and #2 in FIG. 4 of the conventional method. Therefore, compared to the conventional method, degradation in throughput is smaller.

After the detection of the length of sheet, printing operation is performed in accordance with the detected length of sheet so that an optimum throughput can be achieved. Thus, printing operation can be performed with minimum degradation in performance.

Second Exemplary Embodiment

In the first embodiment, although the size detection operation was completed before the /TOP signal for the third sheet was output, the timing of outputting the /TOP signal for the third sheet was still determined based on the maximum size (legal size).

In a second embodiment, when the detection of the length of the first sheet is completed before output of the /TOP signal for a given sheet (e.g. the third sheet), the timing of outputting the /TOP signal for that sheet is changed in accordance with the detected length of sheet.

Since the structure and operation of a color laser printer as an image forming apparatus are similar to those of FIG. 1, the detailed description will be omitted. Since the system configuration of the image forming apparatus is the same as that of FIG. 2, the detailed description will be omitted. The first image forming unit refers to the yellow image forming unit. The image formation starting position refers to the position where the development is started on the photosensitive drum.

In this embodiment, the maximum size sheets that can be set in the paper feeding unit are legal size (sheet size in the conveying direction: 355.6 mm), and sheets actually set in the paper feeding unit are letter size (sheet size in the conveying direction: 279.4 mm).

Figure 7:
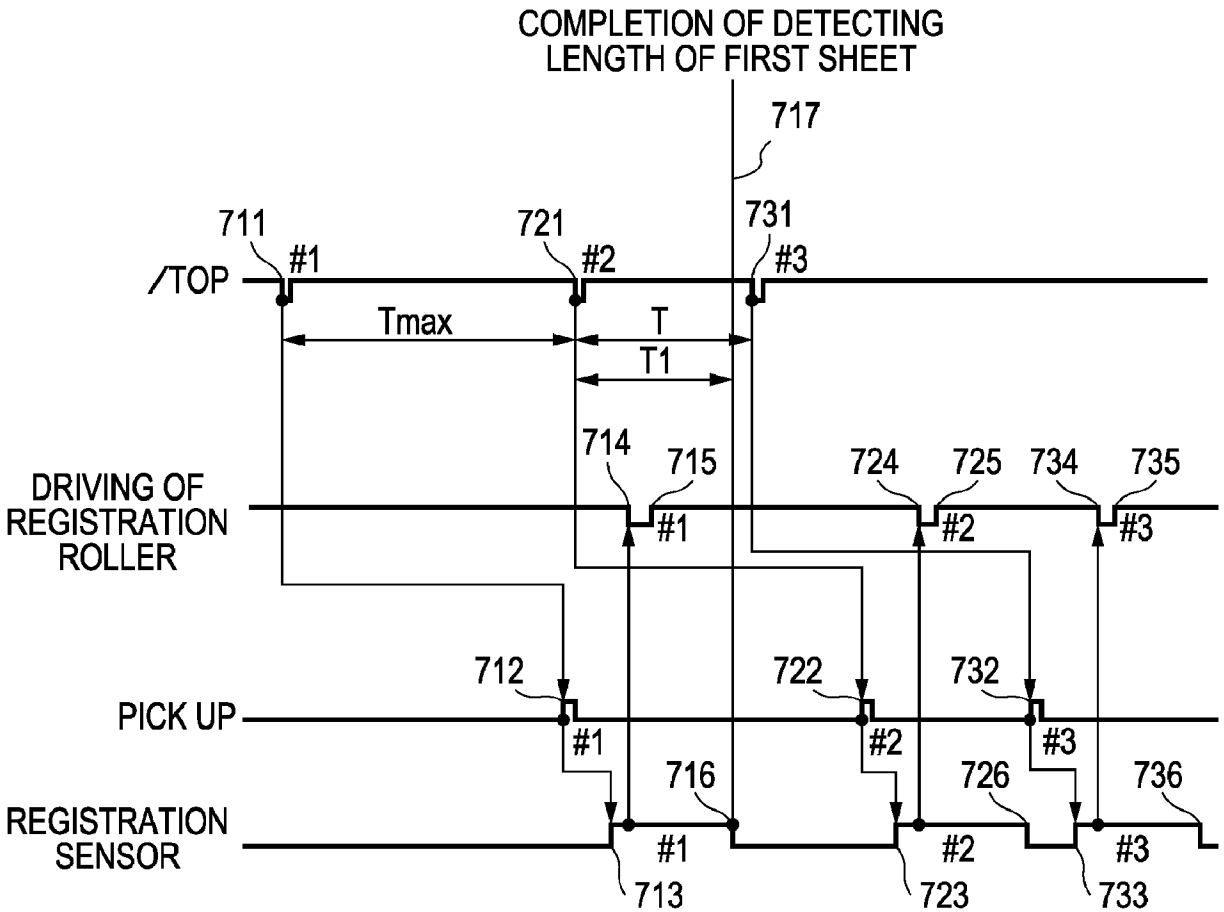
FIG. 7 is a timing chart illustrating the printing operation in a second embodiment.

FIG. 7 is a timing chart of the printing operation in this embodiment. The engine control unit 202 outputs the /TOP signal of the first sheet (711) and sets the outputting interval Tmax of /TOP signals for the subsequent sheets based on the premise that the sheets are legal size. A predetermined time after outputting the /TOP signal of the first sheet, the engine control unit 202 starts the paper feeding operation (712). Based on the time point (713) when the supplied sheet reaches the registration roller 3, the engine control unit 202 conveys the leading edge of the sheet to a desired position and temporarily stops the conveyance of the sheet (714). In synchronization with the toner image formed on the intermediate transfer member, the engine control unit 202 resumes the conveyance of the sheet (715) and transfers the toner image onto the sheet. At this time, the engine control unit 202 measures the time from when the leading edge of the first sheet reaches the sensor 19 (713) to when the trailing edge of the sheet leaves the sensor 19 (716), and based on the measured time, calculates the actual size of the first sheet, the size detection operation being completed at time 717.

The engine control unit 202 monitors the detection of the length of the first sheet during the printing operation. When the detection is completed, the engine control unit 202 calculates the outputting interval T of the /TOP signal for the next sheet based on the elapsed time T1 from the outputting of the last /TOP signal and the detected length of sheet.

Specifically, the engine control unit 202 calculates the /TOP signal outputting interval T from the detected length of sheet. If the time T has elapsed since the outputting of the last /TOP signal, the engine control unit 202 outputs the /TOP signal of the next sheet at that time point.

Until the detection of the length of the first sheet is completed, the engine control unit 202 outputs /TOP signals at the predetermined interval Tmax set based on the maximum size (legal size) of sheets that can be set in the paper feeding unit.

In the case of FIG. 7 of this embodiment, the detection of the length of the first sheet is completed after the outputting of the /TOP signal of the second sheet. Therefore, when the detection of the length of the first sheet is completed, the engine control unit 202 calculates the timing of outputting the /TOP signal of the third sheet and outputs the /TOP signal of the third sheet (717 and 731).

In FIG. 7, the outputting interval T of /TOP signals is calculated by counting the time T1 from the last /TOP signal 721 to the time point 717 when the detection of the length of sheet is completed and adding a predetermined time in accordance with the detected length of sheet (letter size in this embodiment). That is to say, T is calculated from the following formula:

$$T=T1+\alpha$$

where T1 is the elapsed time from the last /TOP signal to the completion of the detecting the length of sheet, and $\alpha$ is the predetermined time. This time $\alpha$ can be appropriately set for each sheet size. It will be appreciated that T1 is being used as a measure of the detected size in this case (instead of the difference between times 713 and 716 at which the leading and trailing edges of the first sheet are detected. This is possible because the time period from the time 721 when the /TOP signal for the second sheet is output to the time 713 is substantially fixed and the delay in completing the size detection (717) after detecting the trailing edge (716) is also fixed and/or negligible.

The interval Tmax between the /TOP signals for the first and second sheets is calculated based on the maximum size (legal size) of sheets that can be set in the paper feeding unit. Reference numeral 722 denotes the start of feeding of the second recording material. Reference numeral 723 denotes the time point when the second recording material reaches the registration roller. Reference numeral 726 denotes the time point when the end of the second recording material passes the sensor 19. Reference numerals 724 and 725 denote the timing of driving the registration roller for the second recording material. Reference numeral 732 denotes the start of feeding of the third recording material. Reference numeral 733 denotes the time point when the third recording material reaches the registration roller. Reference numeral 736 denotes the time point when the end of the third recording material passes the sensor 19. Reference numerals 734 and 735 denote the timing of driving the registration roller for the third recording material.

Figure 8:
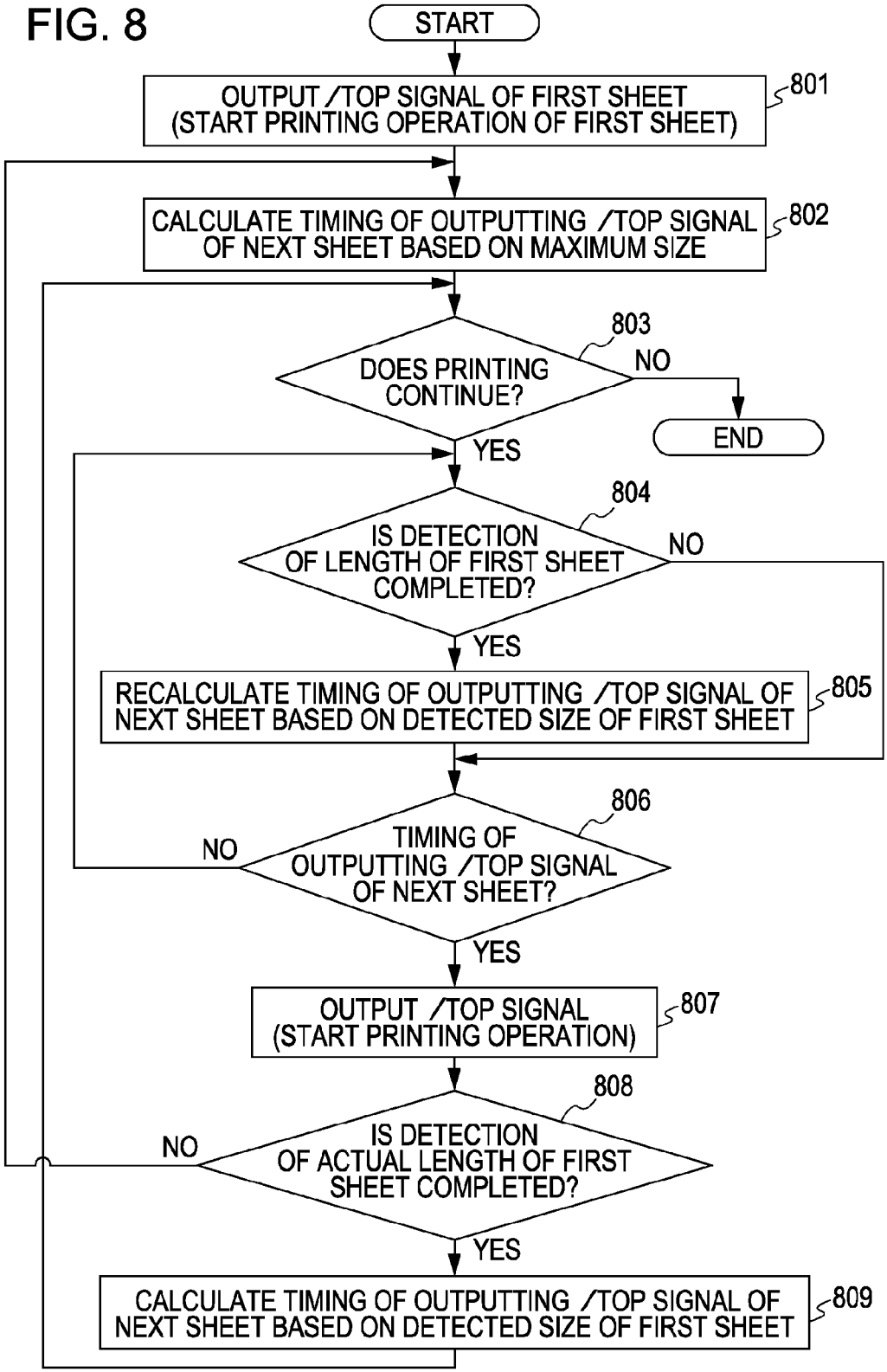
FIG. 8 is a flowchart illustrating the printing operation in the second embodiment.

FIG. 8 is a flowchart illustrating the operational of this embodiment. The engine control unit 202 outputs the /TOP signal of the first sheet and sets the timing of outputting the /TOP signal of the next sheet based on the maximum size (legal size) (801 and 802). Then it is determined whether printing continues at 803. If not, the process ends. If printing does continue, then the process proceeds to 804.

The engine control unit 202 monitors the detection of the length of the first sheet during the printing operation. When the detection is completed, the engine control unit 202 calculates the timing of outputting the /TOP signal of the next sheet based on the elapsed time from the outputting of the last /TOP signal and the detected length of sheet (804 and 805).

Next, it is determined whether the timing of outputting /TOP signal of next sheet is available at 806. If not, the process returns to 804. If yes, the process proceeds to 807 where if the detection of the length of the first sheet is completed, the engine control unit 202 outputs the /TOP signal for the next sheet at the outputting interval of /TOP signals calculated on the above condition (807).

Next, it is determined whether detection of the actual length of the first sheet is completed (808). Once the detection of the length of sheet is completed, the engine control unit 202 determines the timing of outputting the /TOP signal of the next sheet based on the detected length of sheet (809). If the detection of the length of sheet is not completed, the timing of outputting the /TOP signal of the next sheet is determined based on the maximum size (legal size) (802).

As described above, until the engine control unit 202 detects the length of sheet, the engine control unit 202 outputs /TOP signals at such an interval that printing can be performed on the maximum size (legal size in this embodiment) sheets that can be set in the paper feeding unit. When the detection of the length of the first sheet is completed, the engine control unit 202 calculates the timing of outputting the /TOP signal of the next sheet. Therefore, even if the sheet size is unknown, printing operation can be performed without degrading performance.

In this embodiment, since the interval of /TOP signal can be changed earlier compared to the first embodiment, the throughput can be further improved.

Third Exemplary Embodiment

In the first and second embodiments, until the detection of the length of the first sheet is completed, the interval of /TOP signal is determined based on the maximum size (legal size) of sheets that can be set in the paper feeding unit.

In this embodiment, until the detection of the length of sheet is completed, the outputting interval of /TOP signal is determined not based on the maximum size (legal size) but based on a sheet size specified by the controller 201.

Since the timing chart is the same as that of the first embodiment, the description will be omitted. In this embodiment, the interval between /TOP signals is set to a value Tcont specified by the controller, instead of the value Tmax.

Here will be described how to set the outputting interval of /TOP signals based on a sheet size specified by the controller 201 until the detection of the length of sheet is completed.

Here will be described a first case where, when a /TOP signal is output, the timing of outputting the next /TOP signal is set (as in the first embodiment) and a second case where, when the detection of the length of the first sheet is completed, the timing of outputting /TOP signal is calculated (as in the second embodiment).

Figure 9:
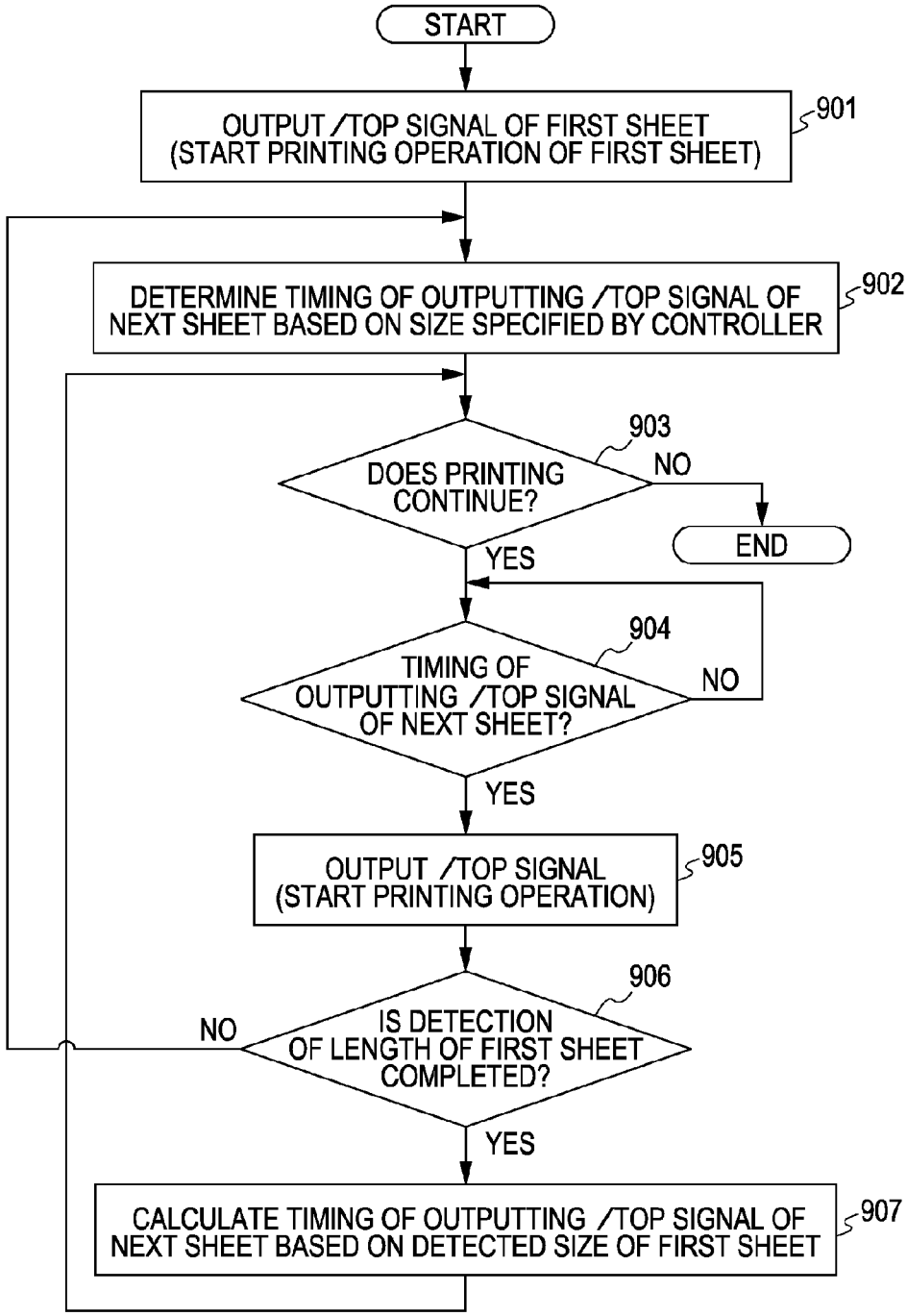
FIG. 9 is a first flowchart illustrating the printing operation in a third embodiment.

FIG. 9 is a flowchart in the case where, when a /TOP signal is output, the timing of outputting the next /TOP signal is set. The engine control unit 202 outputs the /TOP signal of the first sheet and sets the timing of outputting the /TOP signal of the second sheet based on a sheet size specified by the controller 201 (901 and 902). Next, it is determined whether printing continues (903). If not, the process ends. If printing does continue, the process proceeds to 904.

At the timing of outputting the /TOP signal of the second sheet, the engine control unit 202 outputs the /TOP signal of the second sheet (904 and 905). After outputting the /TOP signal of the second sheet, the engine control unit 202 checks if the detection of the length of the first sheet is completed (906). If the detection of the length of the first sheet is completed, the timing of outputting the /TOP signal of the next sheet is set based on the detected length of sheet (907). If the detection of the length of the first sheet is not completed, as with the second sheet, the timing of outputting the /TOP signal of the third sheet is set based on the sheet size specified by the controller 201. Hereafter, the timing of outputting the /TOP signal of the next sheet is determined depending on whether or not the detection of the length of the first sheet is completed.

Figure 10:
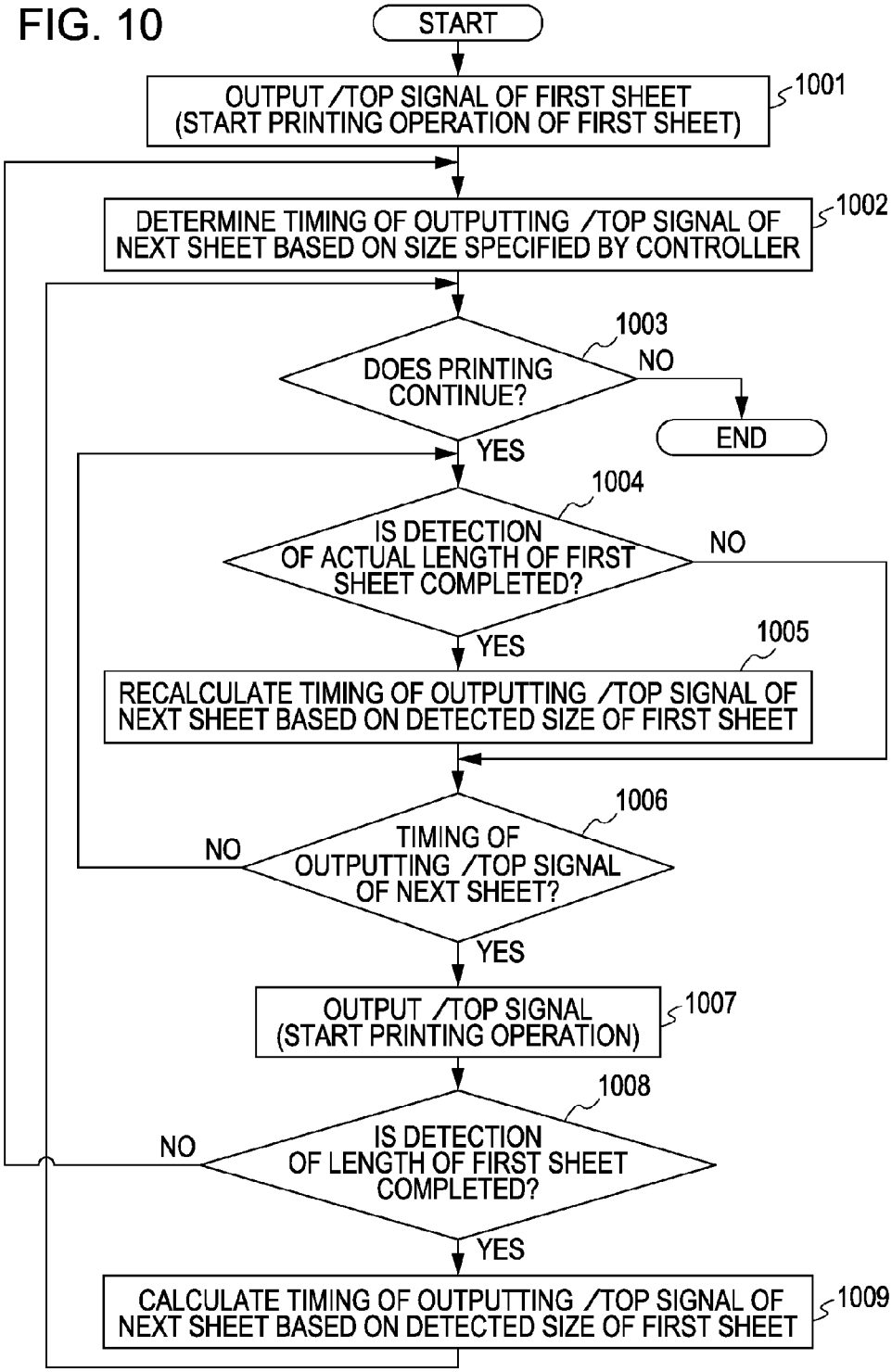
FIG. 10 is a second flowchart illustrating the printing operation in the third embodiment.

FIG. 10 is a flowchart in the case where, when the detection of the length of the first sheet is completed, the timing of outputting /TOP signal is recalculated.

The engine control unit 202 outputs the /TOP signal of the first sheet and sets the timing of outputting the /TOP signal of the next sheet based on a sheet size specified by the controller 201 (1001 and 1002). Next, it is determined whether printing continues (1003). If not, the process ends. If printing does continue, the process proceeds to 1004. The engine control unit 202 monitors the detection of the length of the first sheet during the printing. When the detection is completed, the engine control unit 202 calculates the timing of outputting the /TOP signal for the next sheet based on the elapsed time from the outputting of the last /TOP signal and the detected length of sheet (1004 and 1005).

Next, it is determined whether the timing of outputting /TOP signal of next sheet is available at 1006. If not, the process returns to 1004. If yes, the process proceeds to 1007 where if the detection of the length of the first sheet is completed, the engine control unit 202 outputs the /TOP signal for the next sheet at the calculated timing (1007).

Next, it is determined whether detection of the actual length of the first sheet is completed (1008). Once the detection of the length of sheet is completed, the engine control unit 202 determines the timing of outputting the /TOP signal of the next sheet based on the detected length of sheet (1009). If the detection of the length of sheet is not completed, the timing of outputting the /TOP signal of the next sheet is determined based on the sheet size specified by the controller 201 (1002).

The controller can specify a particular sheet size or a free size. When a free size is specified, an outputting interval of /TOP signal is set so that printing can be surely performed on sheets having a size less than or equal to a certain sheet size.

For example, when the controller specifies "free size 1,"/TOP signals are output based on the legal size. When the controller specifies "free size 2,"/TOP signals are output based on the letter size.

In recent years, a paper cassette capable of accommodating free size sheets has been provided as a paper feeding unit that allows a user to freely set the sheet size. In that case, the controller specifies the maximum sheet size that the free size paper cassette supports as a free size so that printing operation can be performed without degrading performance.

As described above, until the engine control unit 202 completes the detection of the length of sheet, the engine control unit 202 outputs /TOP signals at such an interval that printing can be performed on sheets having the size specified by the controller 201. After the detection of the length of the first sheet is completed, the timing of outputting /TOP signal is set based on the detected sheet length. This makes it possible to perform printing operation without degrading performance even if the sheet size is unknown.

Various changes may be made in each of the above-described first, second, and third embodiments without departing from the spirit of the present invention. Such changes are also included in the scope of the present invention.

The present invention is not limited to the above-described embodiments but includes modifications of the same technical idea.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-286471 filed Oct. 20, 2006, which is hereby incorporated by reference herein in its entirety.

What is claimed is:

1. An image forming apparatus comprising:

a paper feeding unit configured to feed a recording material;

an image forming unit configured to form an image on an image bearing member;

a primary transfer unit configured to transfer the image formed on the image bearing member onto an intermediate transfer member;

a secondary transfer unit configured to transfer the image transferred onto the intermediate transfer member onto the recording material fed from the paper feeding unit;

a size detecting unit configured to detect the size of the recording material; and a setting unit configured to set an interval at which a plurality of images are formed on the intermediate transfer member, wherein the timing to start feeding the recording material from the paper feeding unit is later than the timing to start forming the image with the image forming unit, and wherein the size detecting unit detects the size of the recording material while the plurality of images are formed on the intermediate transfer member at a first interval according to a predetermined recording material size, and after the size detecting unit detects the size of the recording material, if the size of the recording material detected by the size detecting unit is smaller than the predetermined recording material size, the setting unit sets the interval as a second interval that is smaller than the first interval, at which the plurality of images are formed, based on the detected size of the recording material.

2. The image forming apparatus according to claim 1, wherein the distance from the position where feeding of the recording material is started from the paper feeding unit to the position where an image is transferred onto the recording material by the secondary transfer unit is smaller than the distance from the position where image formation on the image bearing member is started by the image forming unit to the position where an image is transferred onto the recording material by the secondary transfer unit.

3. The image forming apparatus according to claim 1, wherein the predetermined recording material size is the maximum length of the recording material supplied to the paper feeding unit in the conveying direction of a recording material.

4. The image forming apparatus according to claim 1, wherein after the size detecting unit detects the size of the recording material, the setting unit calculates the second interval in accordance with the detected recording material size.

5. The image forming apparatus according to claim 1, wherein when the size detecting unit detects the size of the recording material, an interval between an image formed on the intermediate transfer member and an image to be formed next is set as the second interval.

6. The image forming apparatus according to claim 1, wherein the setting unit sets a timing when the recording material is conveyed to the secondary transfer unit according to the interval at which the plurality of images are formed on the intermediate transfer member.

7. The image forming apparatus according to claim 1, wherein the setting unit sets a timing when the recording material is fed from the paper feeding unit according to the interval at which the plurality of images are formed on the intermediate transfer member.

8. An image forming apparatus comprising:

a paper feeding unit configured to feed a recording material;

an image forming unit configured to form an image on an image bearing member;

a primary transfer unit configured to transfer the image formed on the image bearing member onto an intermediate transfer member;

a secondary transfer unit configured to transfer the image transferred onto the intermediate transfer member onto the recording material fed from the paper feeding unit;

a size detecting unit configured to detect the size of the recording material;

a setting unit configured to set an interval at which a plurality of images are formed on the intermediate transfer member; and a specifying unit configured to specify a recording material size, wherein the timing to start feeding the recording material from the paper feeding unit is later than the timing to start forming the image with the image forming unit, and wherein the size detecting unit detects the size of the recording material while the plurality of images are formed on the intermediate transfer member at a first interval according to the recording material size specified by the specifying unit, and after the size detecting unit detects the size of the recording material, if the size of the recording material detected by the size detecting unit is smaller than the recording material size specified by the specifying unit, the setting unit sets the interval as a second interval that is smaller than the first interval, at which the plurality of images are formed, based on the detected size of the recording material.

9. The image forming apparatus according to claim 8, wherein the distance from the position where feeding of the recording material is started from the paper feeding unit to the position where an image is transferred onto the recording material by the secondary transfer unit is smaller than the distance from the position where image formation on the image bearing member is started by the image forming unit to the position where an image is transferred onto the recording material by the secondary transfer unit.

10. The image forming apparatus according to claim 8, wherein the paper feeding unit is capable of supplying a free-size recording material.

11. The image forming apparatus according to claim 8, wherein the recording material size specified by the specifying unit is the maximum length of the recording material supplied to the paper feeding unit in the conveying direction of a recording material.

12. The image forming apparatus according to claim 8, wherein after the size detecting unit detects the size of the recording material, the setting unit calculates the second interval in accordance with the detected recording material size.

13. The image forming apparatus according to claim 8, wherein the specifying unit is capable of specifying a plurality of recording material sizes.

14. The image forming apparatus according to claim 8, wherein when the size detecting unit detects the size of the recording material, an interval between an image formed on the intermediate transfer member and an image to be formed next is set as the second interval.

15. The image forming apparatus according to claim 8, wherein the setting unit sets a timing when the recording material is conveyed to the secondary transfer unit according to the interval at which the plurality of images are formed on the intermediate transfer member.

16. The image forming apparatus according to claim 8, wherein the setting unit sets a timing when the recording material is fed from the paper feeding unit according to the interval at which the plurality of images are formed on the intermediate transfer member.

* * * * *